US006341556B1

(12) United States Patent
Endo

(10) Patent No.: US 6,341,556 B1
(45) Date of Patent: Jan. 29, 2002

(54) WIPING DEVICE OF INTAGLIO PRINTING PRESS

(75) Inventor: Yutaka Endo, Chiba (JP)

(73) Assignee: Komori Corporation, Tokyo (JP)

( * ) Notice: Subject to any disclaimer, the term of this patent is extended or adjusted under 35 U.S.C. 154(b) by 0 days.

(21) Appl. No.: 09/577,565

(22) Filed: May 25, 2000

(30) Foreign Application Priority Data

May 25, 1999 (JP) ..... 11-144278

(51) Int. Cl.[7] ..... B41F 9/08; B41F 9/10

(52) U.S. Cl. ..... 101/167; 101/155; 101/423; 101/424; 101/161

(58) Field of Search ..... 101/424, 423, 101/154, 155, 167, 169, 156, 161

(56) References Cited

U.S. PATENT DOCUMENTS

| | | | | |
|---|---|---|---|---|
| 2,178,639 A | | 11/1939 | Marquardt | 101/155 |
| 2,585,617 A | * | 2/1952 | Battey | 101/156 |
| 3,861,861 A | | 1/1975 | Thettu | 432/59 |
| 4,240,347 A | * | 12/1980 | Hazelton et al. | 101/156 |
| 4,411,042 A | | 10/1983 | Sakata et al. | 15/256.51 |
| 4,499,825 A | | 2/1985 | Uno | 101/167 |
| 5,012,739 A | * | 5/1991 | Loos et al. | 101/423 |
| 5,636,570 A | * | 6/1997 | Ebina et al. | 101/424 |
| 5,842,418 A | * | 12/1998 | Corrado et al. | 101/425 |
| 6,247,405 B1 | * | 6/2001 | Hanke et al. | 101/424 |

FOREIGN PATENT DOCUMENTS

| | | |
|---|---|---|
| DE | 675305 | 5/1939 |
| DE | 1229547 | 12/1966 |
| DE | 2935288 | 3/1980 |
| DE | 4330357 | 2/1995 |
| EP | 0081808 | 6/1983 |
| EP | 0514756 | 11/1992 |
| EP | 0622191 | 11/1994 |
| GB | 610445 | 10/1948 |
| JP | 59933 | 2/1993 |
| JP | 715339 | 3/1995 |
| JP | 10329301 | 12/1998 |

* cited by examiner

*Primary Examiner*—Daniel J. Colilla

(57) ABSTRACT

A wiping device of an intaglio printing press comprises a liquid tank storing a cleaning liquid inside, a wiping roll disposed in the liquid tank and contacting a plate of an intaglio cylinder for removing ink on a surface portion of the plate, a base plate disposed in the liquid tank, and a wiping roll cleaning sheet supported by the base plate and contacting a circumferential surface of the wiping roll for removing ink adhering to the circumferential surface of the wiping roll. The wiping roll cleaning sheet comprises a supporting wire net tautly supported on the base plate, a cleaning wire net supported by the supporting wire net so as to contact the circumferential surface of the wiping roll, and an elastic cloth supported by the supporting wire net so as to be interposed between the supporting wire net and the cleaning wire net, for pressing the cleaning wire net against the circumferential surface of the wiping roll. The wiping device requires less labor for maintenance and check.

7 Claims, 4 Drawing Sheets

CONVENTIONAL ART

WIPING DEVICE OF INTAGLIO PRINTING PRESS

BACKGROUND OF THE INVENTION

1. Field of the Invention

The present invention relates to a wiping device for removing surplus ink on a surface portion of an intaglio of an intaglio printing press.

2. Description of the Related Art

A known wiping device for removing surplus ink on a surface portion of an intaglio of an intaglio printing press is described, for example, in Japanese Utility Model Publication No. 7-15339. This wiping device is illustrated in FIG. 4.

As shown in FIG. 4, a liquid tank 111 which stores a cleaning liquid 1 inside is disposed below an intaglio cylinder 100. Inside the liquid tank 111, a wiping roll 112, which is in contact with an intaglio 101 of the intaglio cylinder 100 and capable of reciprocating along an axial direction while rotating in a direction opposite to the rotating direction of the intaglio cylinder 100, is disposed in such a manner as to be immersed in the cleaning liquid 1. Inside the liquid tank 111, a plate pad 113 of a carbon tool steel product (SK steel) having many small holes formed therein is fixedly supported in a bending state so as to contact a circumferential surface of the wiping roll 112 at a predetermined urging pressure. Downstream from the plate pad 113 in the rotating direction of the wiping roll 112, a finishing brush 114 is disposed so as to contact the circumferential surface of the wiping roll 112. Downstream from the finishing brush 114 in the rotating direction of the wiping roll 112, a doctor 115 is disposed in contact with the circumferential surface of the wiping roll 112.

With the foregoing wiping device, when the wiping roll 112 is reciprocated along the axial direction while being rotated in the direction opposite to the rotating direction of the intaglio cylinder 100, the wiping roll 112 evenly wipes off surplus ink adhering to a surface portion of the intaglio 101. Thus, only ink supplied to depressions of the intaglio 101 can be transferred to paper held on an impression cylinder to print the paper. As the wiping roll 112 is rotated and reciprocated, its circumferential surface that has wiped off the ink enters the cleaning liquid 1. The ink adhering to the circumferential surface is scraped off by peripheral edges of the small holes of the plate pad 113, whereafter the finishing brush 114 cleans the circumferential surface in a finishing manner to rinse out the ink into the cleaning liquid 1. The cleaned circumferential surface ascends from inside the cleaning liquid 1, has the cleaning liquid 1 thereon scraped off by the doctor 115, and then is used again for wiping off ink.

According to the above-described wiping device of an intaglio printing press described in Japanese Utility Model Publication No. 7-15339, ink cannot be removed fully when the urging pressure of the plate pad 113 on the wiping roll 112 is weak. If this urging pressure is too high, the plate pad 113 may plastically deform or abnormally wear down. Thus, the plate pad 113 has to be fixedly supported so that its urging pressure will take a prescribed value. To fulfill this requirement, mounting of the plate pad 113 has been laborious, decreasing the efficiency of maintenance and check.

SUMMARY OF THE INVENTION

The present invention has been accomplished in light of the above-described problems with the earlier technology. It is an object of this invention to provide a wiping device of an intaglio printing press which requires less labor for maintenance and check.

The present invention, as a means of attaining the above object, is a wiping device of an intaglio printing press, comprising:

a wiping roll in contact with a plate of an intaglio cylinder for removing ink on a surface portion of the plate;

a base member supported to be opposed to the wiping roll; and a wiping roll cleaning sheet supported by the base member, and contacting a circumferential surface of the wiping roll for removing ink adhering to the circumferential surface of the wiping roll, wherein the wiping roll cleaning sheet comprises a supporting sheet supported by the base member and having a plurality of through-holes, a cleaning sheet supported by the supporting sheet so as to contact the circumferential surface of the wiping roll, and having a plurality of through-holes, and a pressing sheet supported by the supporting sheet so as to be interposed between the cleaning sheet and the supporting sheet, and having a plurality of through-holes, for pressing the cleaning sheet against the circumferential surface of the wiping roll.

In the wiping device of an intaglio printing press, tautly supporting means for tautly supporting the supporting sheet of the wiping roll cleaning sheet and capable of adjusting tension of the supporting sheet may be provided on the base member.

In the wiping device of an intaglio printing press, the cleaning sheet and the pressing sheet of the wiping roll cleaning sheet may each have an upstream end, in a rotating direction of the wiping roll, fixedly supported on the base member, and may each have a downstream end, in the rotating direction of the wiping roll, left open without being fixedly supported.

In the wiping device of an intaglio printing press, the supporting sheet of the wiping roll cleaning sheet may be a wire net, the cleaning sheet of the wiping roll cleaning sheet may be a metallic plate pad having many small holes formed therein, or a wire net, and the pressing sheet of the wiping roll cleaning sheet may be an elastic cloth comprising a resinous unwoven fabric.

In the wiping device of an intaglio printing press, the wire net as the supporting sheet may be an assembly of wires having a longitudinal direction pointed in an axial direction of the wiping roll, and wires having a longitudinal direction pointed in a rotating direction of the wiping roll, while the wire net as the cleaning sheet may be an assembly of wires having a longitudinal direction pointed in a direction intersecting, at an angle other than a right angle, with the axial direction of the wiping roll, and wires having a longitudinal direction pointed in a direction intersecting, at an angle other than a right angle, with the rotating direction of the wiping roll.

In the wiping device of an intaglio printing press, the wire net as the cleaning sheet may be the assembly of the wires having the longitudinal direction pointed in the direction intersecting, at an angle of 45°, with the axial direction of the wiping roll, and the wires having the longitudinal direction pointed in the direction intersecting, at an angle of 45°, with the rotating direction of the wiping roll.

The wiping device of an intaglio printing press may further include a cleaning unwoven fabric sheet comprising an unwoven fabric which is disposed, downstream from the wiping roll cleaning sheet in a rotating direction of the wiping roll, so as to contact the circumferential surface of the wiping roll, for cleaning the circumferential surface of the wiping roll.

BRIEF DESCRIPTION OF THE DRAWINGS

The above and other objects, features and advantages of the present invention will become more apparent from the following description taken in connection with the accompanying drawings, in which.

DETAILED DESCRIPTION OF THE PREFERRED EMBODIMENTS

Figure 1:
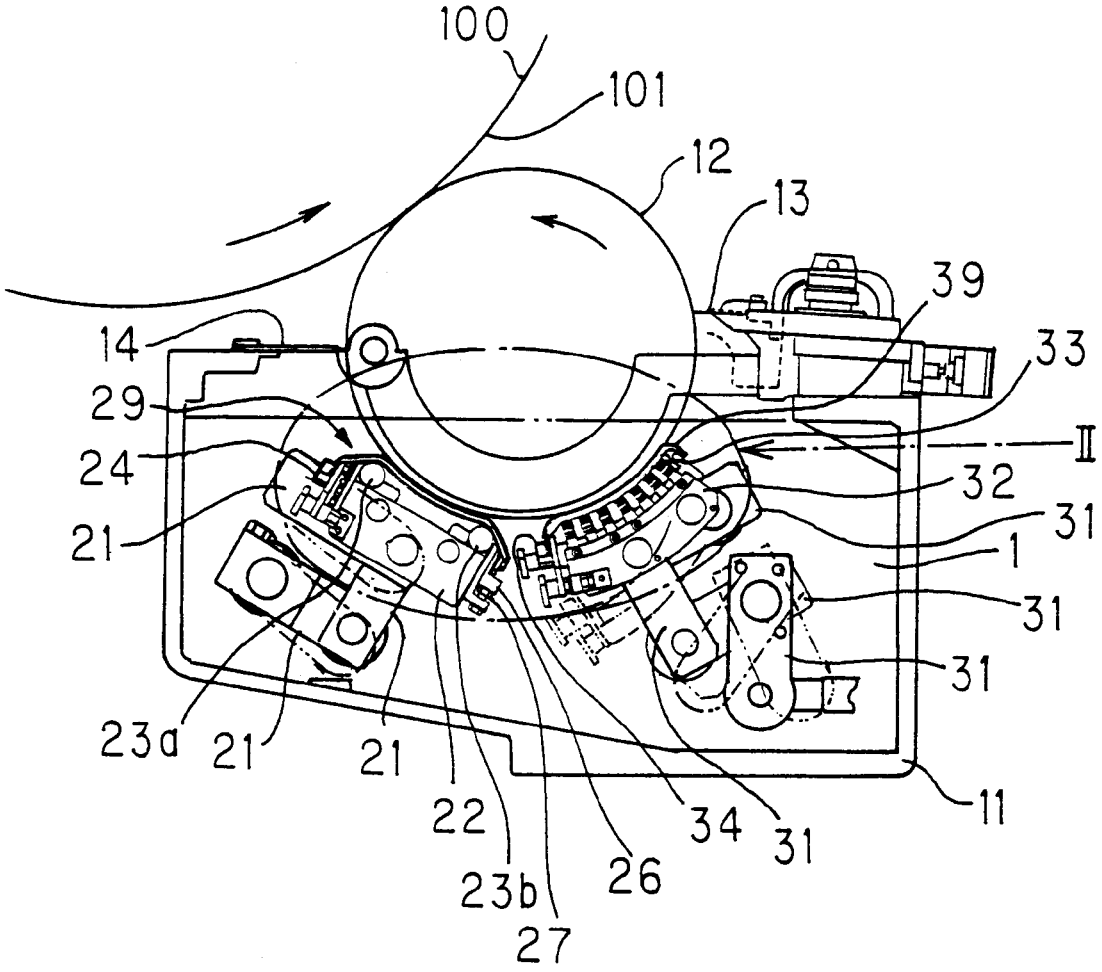
FIG. 1 is an overall schematic constitution drawing showing an embodiment of a wiping device of an intaglio printing press according to the present invention.
Figure 2:
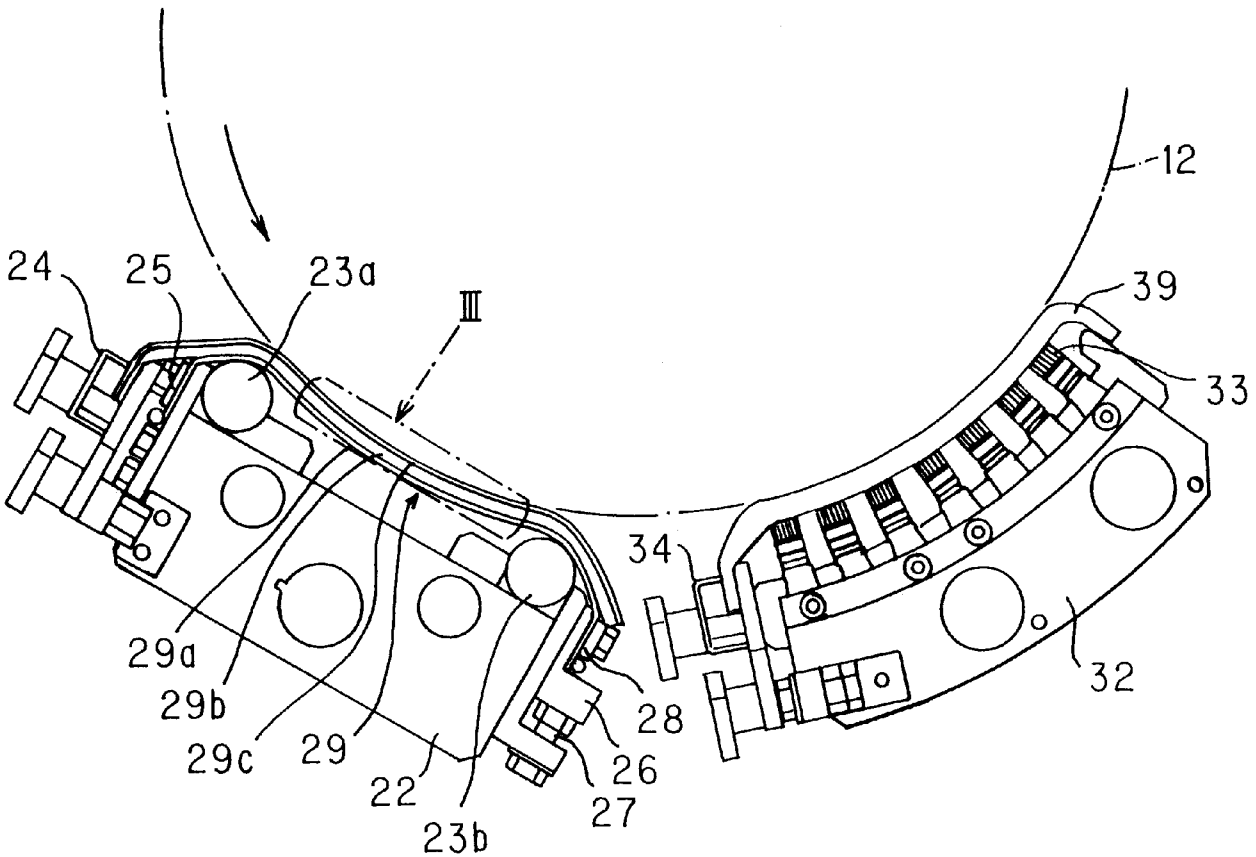
FIG. 2 is an extracted enlarged view of a portion indicated by an arrow II in FIG. 1.
Figure 3:
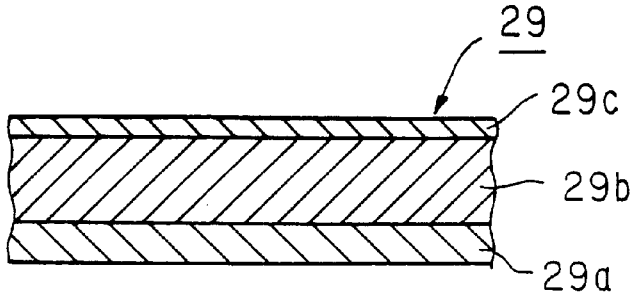
FIGS. 3(*a*) to 3(*c*) are explanation drawings of a portion indicated by an arrow III in FIG. 2.
Figure 3:
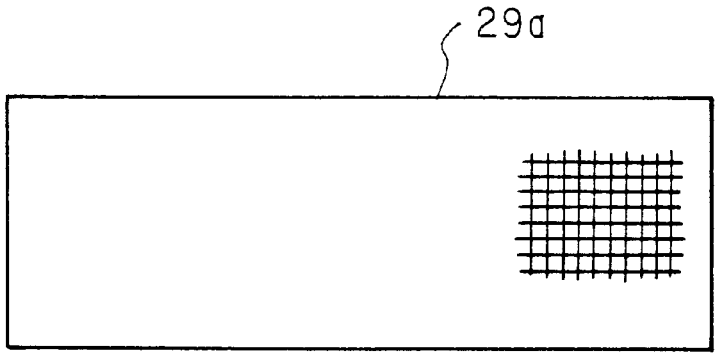
Figure 3:
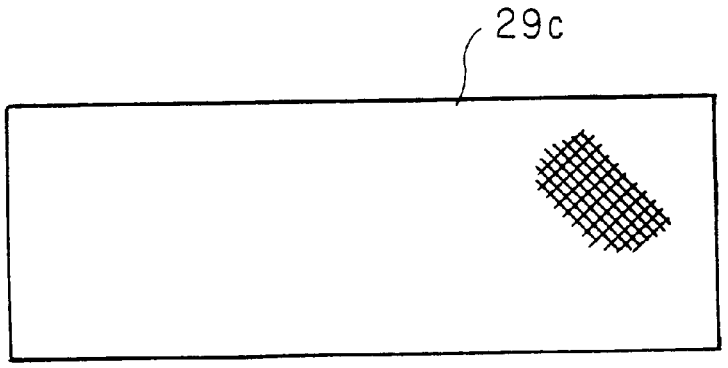
Figure 4:
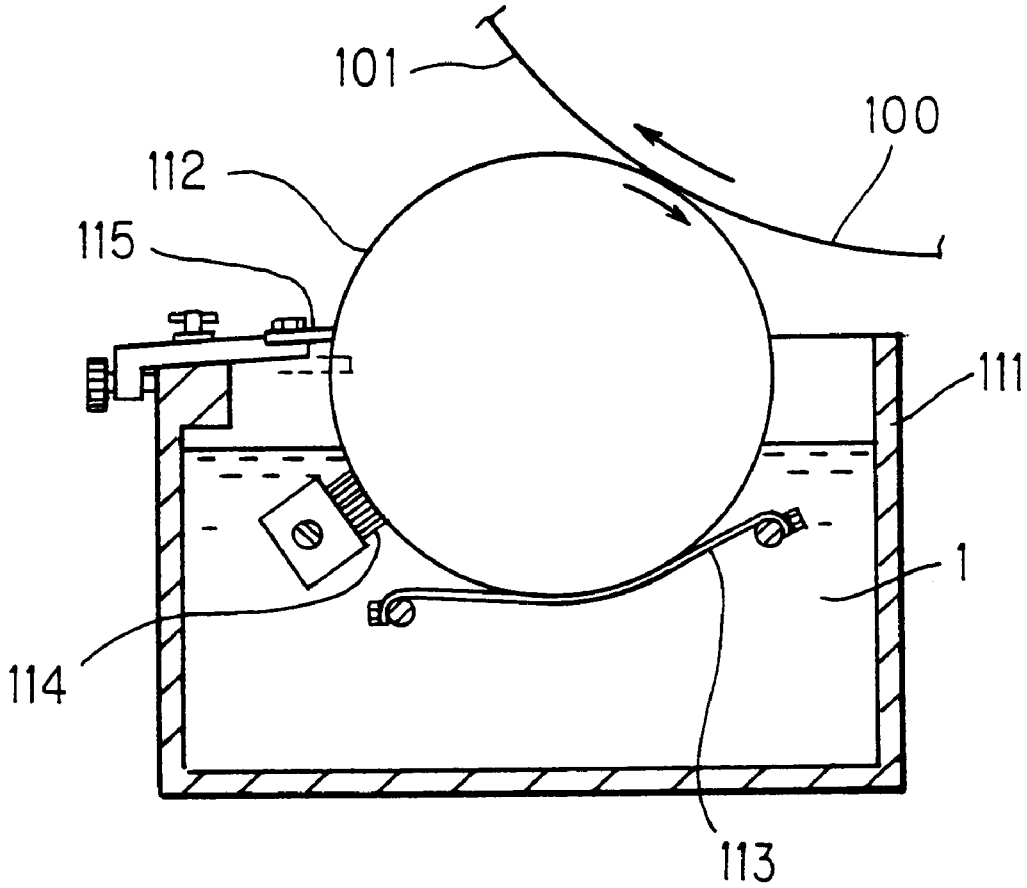
FIG. 4 is a schematic constitution drawing of an example of a wiping device of a conventional intaglio printing press.

Embodiments of a wiping device of an intaglio printing press according to the present invention will now be described in detail with reference to FIG. 1 to FIGS. 3(*a*) to 3(*c*). FIG. 1 is an overall schematic constitution drawing of the wiping device. FIG. 2 is an extracted enlarged view of a portion indicated by an arrow II in FIG. 1. FIGS. 3(*a*) to 3(*c*) are explanation drawings of a portion indicated by an arrow III in FIG. 2.

As shown in FIG. 1, a liquid tank 11 which stores a cleaning liquid 1 inside is disposed below an intaglio cylinder 100. Inside the liquid tank 11, a wiping roll 12, which is in contact with an intaglio 101 of the intaglio cylinder 100 and capable of reciprocating along an axial direction while rotating in a direction opposite to the rotating direction of the intaglio cylinder 100, is disposed in such a manner as to be immersed in the cleaning liquid 1. Inside the liquid tank 11, a base plate 22, which is a base member movable toward and away from a circumferential surface of the wiping roll 12 in accordance with the pivoting of a link plate 21, is disposed with its longitudinal direction being pointed along an axial direction of the wiping roll 12.

As shown in FIG. 2, at both ends, in a circumferential direction of the wiping roll 12, of a surface of the base plate 22 opposed to the wiping roll 12, support bars 23*a*, 23*b* as a pair are provided, with their longitudinal direction being pointed along an axial direction of the wiping roll 12. Clamps 24, 25 are provided on an upstream end face of the base plate 22 in a rotating direction of the wiping roll 12. On a downstream end face of the base plate 22 in the rotating direction of the wiping roll 12, a slide plate 26 is provided which is slidable along a diametrical direction of the wiping roll 12. Adjustment by an adjusting screw 27 enables the slide plate 26 to set the position of the base plate 22 in the diametrical direction of the wiping roll 12. The slide plate 26 is provided with a clamp 28. Beside the surface of the base plate 22 opposed to the wiping roll 12, a wiping roll cleaning sheet 29 in contact with the circumferential surface of the wiping roll 12 for removing ink adhering to the circumferential surface is supported like a bridge between the support bars 23*a* and 23*b*.

As shown in FIG. 3, the wiping roll cleaning sheet 29 comprises a supporting wire net 29*a* of stainless steel which is a supporting sheet having a plurality of throughholes, a cleaning wire net 29*c* of stainless steel which is a cleaning sheet supported by the supporting wire net 29*a* so as to contact the circumferential surface of the wiping roll 12, and having a plurality of through-holes, and an elastic cloth 29*b* comprising an unwoven fabric of synthetic resin, such as nylon, (e.g., a scrubbing nylon brush) which is a pressing sheet supported by the supporting wire net 29*a* so as to be interposed between the supporting wire net 29*a* and the cleaning wire net 29*c*, and having a plurality of through-holes, for pressing the cleaning wire net 29*c* against the circumferential surface of the wiping roll 12.

As shown in FIG. 2, the supporting wire net 29*a* of the wiping roll cleaning sheet 29 has an upstream end, in the rotating direction of the wiping roll 12, fixedly held by the clamp 25, and has a downstream end, in the rotating direction of the wiping roll 12, fixedly held by the clamp 28. Whereas the elastic cloth 29*b* and the cleaning wire net 29*c* of the wiping roll cleaning sheet 29 each have an upstream end, in the rotating direction of the wiping roll 12, fixedly held by the clamp 24, and each have a downstream end, in the rotating direction of the wiping roll 12, kept free without being fixedly held. That is, in the wiping roll cleaning sheet 29, the supporting wire net 29*a* is tautly supported on the base plate 22, the elastic cloth 29*b* and the cleaning wire net 29*c* are supported on the supporting wire net 29*a*, and the position of the slide plate 26 is adjusted by the adjustment of the adjusting screw 27, whereby the tension of the supporting wire net 29*a* is adjusted.

In the present embodiment, the clamps 24, 28, the slide plate 26, and the adjusting screw 27 constitute tautly supporting means.

As shown in FIG. 3(*b*), the supporting wire net 29*a* of the wiping roll cleaning sheet 29 is an assembly of wires having a longitudinal direction pointed in the axial direction of the wiping roll 12, and wires having a longitudinal direction pointed in the rotating direction of the wiping roll 12. Whereas the cleaning wire net 29*c* of the wiping roll cleaning sheet 29, as shown in FIG. 3(*c*), is an assembly of wires having a longitudinal direction pointed in a direction intersecting, at an angle other than a right angle (e.g., 45°), with the axial direction of the wiping roll 12, and wires having a longitudinal direction pointed in a direction intersecting, at an angle other than a right angle (e.g., 45°), with the rotating direction of the wiping roll 12.

As shown in FIGS. 1 and 2, downstream from the base plate 22 in the rotating direction of the wiping roll 12, a base plate 32, which is moved toward and away from the circumferential surface of the wiping roll 12 in accordance with the pivoting of a link plate 31, is disposed with its longitudinal direction being pointed along the axial direction of the wiping roll 12.

As shown in FIG. 2, a surface of the base plate 32 opposed to the wiping roll 12 is planted with an elastic brush 33 of synthetic resin or the like. A clamp 34 is provided on an upstream end face of the base plate 32 in the rotating direction of the wiping roll 12. On the brush 33 of the base plate 32, a cleaning unwoven fabric sheet 39 comprising an unwoven fabric of synthetic resin is provided like a bridge between both ends of the base plate 32 in the rotating direction of the wiping roll 12. The cleaning unwoven fabric sheet 39 has an upstream end, in the rotating direction of the wiping roll 12, fixedly held by the clamp 34, and has a downstream end, in the rotating direction of the wiping roll 12, kept free without being fixedly held. In FIG. 1, the reference numerals 13 and 14 denote doctors.

The actions of the foregoing wiping device of an intaglio printing press will be described below.

When the wiping roll 12 is reciprocated along the axial direction while being rotated in the direction opposite to the rotating direction of the intaglio cylinder 100, the wiping roll 12 evenly wipes off surplus ink adhering to a surface portion of the intaglio 101. Thus, only ink supplied to depressions of the intaglio 101 can be transferred to paper held on an impression cylinder to print the paper. As the wiping roll 12 is rotated and reciprocated, its circumferential surface that has wiped off the ink enters the cleaning liquid 1. The ink adhering to the circumferential surface is scraped off by the meshes of the cleaning wire net 29*c* of the wiping roll cleaning sheet 29, passed through the elastic cloth 29*b* and the supporting wire net 29*a,* and rinsed out into the cleaning liquid 1. Further, the cleaned circumferential surface is finish-cleaned by the cleaning unwoven fabric sheet 39. The finish-cleaned circumferential surface ascends from inside the cleaning liquid 1, has the cleaning liquid 1 thereon scraped off by the doctor 13, and then is used again for wiping off ink.

The urging pressure of the wiping roll cleaning sheet 29 on the wiping roll 12 can be easily set at a prescribed value by adjusting the position of the slide plate 26 by means of the adjusting screw 27 to adjust the tension of the supporting wire net 29*a.* Even if the urging pressure of the wiping roll cleaning sheet 29 on the wiping roll 12 is too high, the elastic cloth 29*b* pushes the cleaning wire net 29*c* toward the wiping roll 12. Thus, the cleaning wire net 29*c* will not bend excessively, but will contact the wiping roll 12 uniformly. Hence, it becomes possible to set, with extreme ease, an appropriate urging pressure which will not cause plastic deformation or abnormal wear to the wiping roll cleaning sheet 29. Consequently, the wiping roll cleaning sheet 29 can be easily supported fixedly on the base plate 22, and the efficiency of maintenance and check can be markedly increased.

Furthermore, the cleaning wire net 29*c* of the wiping roll cleaning sheet 29, as shown in FIG. 3(*c*), is an assembly of wires having a longitudinal direction pointed in a direction intersecting, at an angle other than a right angle (e.g., 45°), with the axial direction of the wiping roll 12, and wires having a longitudinal direction pointed in a direction intersecting, at an angle other than a right angle (e.g., 45°), with the rotating direction of the wiping roll 12. Thus, the strength of the wiping roll cleaning sheet 29 against the axially reciprocating movement of the wiping roll 12 can be enhanced, its life can be prolonged, and the frequency of its maintenance and check can be decreased.

Besides, the wire nets 29*a,* 29*c* and the elastic cloth 29*b* of the wiping roll cleaning sheet 29 may be general-purpose products in common use. Thus, the wiping roll cleaning sheet 29 as a replacement can be easily procured, and the cost for its maintenance and check can be reduced.

Also, the cleaning unwoven fabric sheet 39 has been disposed downstream from the wiping roll cleaning sheet 29 in the rotating direction of the wiping roll 12. Thus, the ink adhering to the circumferential surface of the wiping roll 12 can be eliminated evenly and reliably. This makes it possible to remove surplus ink on the surface Portion of the intaglio 101 of the intaglio cylinder 100 more reliably.

In the present embodiment, the supporting wire net 29*a* of the wiping roll cleaning sheet 29 has been tautly supported in such a manner that the tension of the supporting wire net 29*a* can be adjusted. Where necessary, however, both ends of the supporting wire net 29*a* may be tautly supported such that the initial tension can be kept.

In the present embodiment, moreover, the cleaning liquid 1 has been stored in the liquid tank 11, and the wiping roll 12 has been immersed in the cleaning liquid 1. However, a jetting nozzle for jetting the cleaning liquid 1 may be provided in the tank to direct a jet of the cleaning liquid 1 at the wiping roll 12.

As the cleaning sheet of the wiping roll cleaning sheet, a general-purpose wire net in common use may be used as stated earlier. Furthermore, the plate pad of a carbon tool steel product (SK steel) having many small holes formed therein, which has been described in connection with the earlier technology, may also be used.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A wiping device of an intaglio printing press, comprising:

a wiping roll in contact with a plate of an intaglio cylinder for removing ink on a surface portion of the plate;

a base member supported to be opposed to said wiping roll; and a wiping roll cleaning sheet supported by said base member, and contacting a circumferential surface of said wiping roll for removing ink adhering to the circumferential surface of said wiping roll, wherein said wiping roll cleaning sheet comprises a supporting sheet supported by said base member and having a plurality of through-holes, a cleaning sheet supported by said supporting sheet so as to contact the circumferential surface of said wiping roll, and having a plurality of through-holes, and a pressing sheet supported by said supporting sheet so as to be interposed between said cleaning sheet and said supporting sheet, and having a plurality of through-holes, for pressing said cleaning sheet against the circumferential surface of said wiping roll.

2. A wiping device of an intaglio printing press as claimed in claim 1, wherein tautly supporting means for tautly supporting said supporting sheet of said wiping roll cleaning sheet and capable of adjusting tension of said supporting sheet is provided on said base member.

3. A wiping device of an intaglio printing press as claimed in claim 1, wherein said cleaning sheet and said pressing sheet of said wiping roll cleaning sheet each have an upstream end, in a rotating direction of said wiping roll, fixedly supported on said base member, and each have a downstream end, in said rotating direction of said wiping roll, left open without being fixedly supported.

4. A wiping device of an intaglio printing press as claimed in claim 1, wherein said supporting sheet of said wiping roll cleaning sheet is a wire net, said cleaning sheet of said wiping roll cleaning sheet is a metallic plate pad having many small holes formed therein, or a wire net, and said pressing sheet of said wiping roll cleaning sheet is an elastic cloth comprising a resinous unwoven fabric.

5. A wiping device of an intaglio printing press as claimed in claim 4, wherein said wire net as said supporting sheet is an assembly of wires having a longitudinal direction pointed in an axial direction of said wiping roll, and wires having a longitudinal direction pointed in a rotating direction of said wiping roll, while said wire net as said cleaning sheet is an assembly of wires having a longitudinal direction pointed in a direction intersecting, at an angle other than a right angle, with the axial direction of said wiping roll, and wires having a longitudinal direction pointed in a direction intersecting, at an angle other than a right angle, with the rotating direction of said wiping roll.

6. A wiping device of an intaglio printing press as claimed in claim 5, wherein said wire net as said cleaning sheet is the assembly of the wires having the longitudinal direction pointed in the direction intersecting, at an angle of 45°, with the axial direction of said wiping roll, and wires having the longitudinal direction pointed in the direction intersecting, at an angle of 45°, with the rotating direction of said wiping roll.

7. A wiping device of an intaglio printing press as claimed in claim 1, further including a cleaning unwoven fabric sheet comprising an unwoven fabric which is disposed, downstream from said wiping roll cleaning sheet in a rotating direction of said wiping roll, so as to contact the circumferential surface of said wiping roll, for cleaning the circumferential surface of said wiping roll.

* * * * *